United States Patent [19]

Moreau et al.

[11] Patent Number: 4,793,059

[45] Date of Patent: Dec. 27, 1988

[54] AUTOMATIC GROUNDING CLIP

[75] Inventors: Bernard Moreau, Aixe sur Vienne; Roger Parlatore, Solignac, both of France

[73] Assignee: Pass & Seymour, Inc., Syracuse, N.Y.

[21] Appl. No.: 164,189

[22] Filed: Mar. 4, 1988

Related U.S. Application Data

[62] Division of Ser. No. 017,607, Feb. 24, 1987, Pat. No. 4,745,523.

[51] Int. Cl.[4] ..... H01R 3/06

[52] U.S. Cl. ..... 29/854; 174/51; 439/97; 29/857; 361/356

[58] Field of Search ..... 29/854, 857, 825; 174/51, 53; 439/97, 539; 361/356, 357, 360, 376, 417, 419, 424, 428, 331; 200/297, 153 G, 51 R

[56] References Cited

U.S. PATENT DOCUMENTS

| | | | |
|---|---|---|---|
| 3,432,793 | 3/1969 | Muska | 439/97 |
| 3,639,884 | 2/1972 | Drapkin | 439/97 |
| 3,723,941 | 3/1973 | Schumacher | 439/97 |
| 3,728,468 | 4/1973 | Grauer | 439/97 |
| 3,757,268 | 9/1973 | Genovese | 439/97 |
| 3,885,847 | 5/1975 | Thibeault | 439/97 |
| 3,890,026 | 6/1975 | Gattland, Jr. | 174/51 |
| 3,963,292 | 6/1976 | Smith | 439/97 |
| 4,717,349 | 1/1988 | Johnson | 29/854 |
| 4,745,523 | 5/1988 | Moreau | 361/356 |

*Primary Examiner*—Gerald P. Tolin
*Attorney, Agent, or Firm*—Charles S. McGuire

[57] ABSTRACT

An automatic grounding means for a wiring device is provided by a spring clip formed from a single piece of wire in a generally U-shaped configuration, bent upwardly at both ends. The bent end portions are inserted through a pair of openings on opposite sides of the conventional mounting screw slot in the ears on the yoke of the wiring device, and are further bent either toward or away from one another to maintain the clip in firm engagement with the yoke without welding or other such permanent connection. When mounted on the yoke, parallel legs of the clip extend across the screw slot and are spaced by a distance less than the diameter of the mounting screw which thereby contacts the legs, flexing them outwardly, as the mounting screw is passed through the slot and between the clip legs to engage the flush box in which the wiring device is mounted. The engagement of the clip with the yoke assures a low resistance grounding path from the yoke to the clip to the screw to the flush box. The clip is disclosed in two embodiments respectively suited for automatic and manual assembly of the clip with the yoke.

7 Claims, 1 Drawing Sheet

AUTOMATIC GROUNDING CLIP

REFERENCE TO RELATED APPLICATION

This application is a division of application Ser. No. 017,607 filed Feb. 24, 1987 now U.S. Pat. No. 4,745,523.

BACKGROUND OF THE INVENTION

The present invention relates to so-called automatic grounding means for electrical wiring devices and, more specifically, to that class of automatic grounding means wherein a metallic clip is affixed to the mounting strap or yoke of the wiring device for contact by a screw which connects the device to a wall-mounted box.

Wiring devices such as switches or plug-receiving receptacles must be properly grounded in order to protect the user against dangerous electrical shorts that might occur, for example, in the wiring of equipment connected to the device. Such wiring devices are conventionally mounted in metal boxes which are attached to structural members at ground potential. Metal screws extending through oversized openings (i.e., larger than the screw diameter) in each end of a mounting strap or yoke serve to connect the wiring device to the box. Thus, the device is effectively grounded by the screw providing a low resistance electrical connection between the yoke and the mounting box.

It is sometimes found in such installations that the mounting screw is not always in firm contact with the yoke, due to the necessity of providing oversized openings in the yoke ends. Tis may be due to a slight misalignment in the position of the yoke as a face plate is mounted over the wiring device, or may be caused by other factors, even though the screw is initially in the desired contact with the yoke. In any case, the result is that a good grounding connection is not always provided for the yoke of the wiring device, and therefore for electrical appliances and the like which are connected thereto.

One approach to the foregoing problem has been to attach so-called automatic grounding clips to the yoke in order to insure that the necessary grounding connection is made. Typical examples of such clips are found, for example, in U.S. Pat. Nos. 3,432,793, 3,639,884, 3,723,941, 3,728,468, 3,757,268, 3,885,847 and 3,963,292. Of these patents, probably those bearing the closest relationship to the present invention are U.S. Pat. Nos. 3,432,793 and 3,639,884 of Muska et al, and Drapkin, respectively. In the Muska et al design, a pair of wires extend across the screw-receiving openings in the yoke and are welded to the yoke. The wires are spaced by a distance less than the diameter of the mounting screw which is thus in contact with both wires when passing therebetween, assuring a low resistance ground path from the yoke to the wires, screw and box. Drapkin provides a single wire extending across the screw-receiving opening behind the strap. One end of the wire is anchored within a small aperture and the other end is free to slide in a slot extending inwardly from an edge of the strap.

It is a principal object of the present invention to provide an automatic grounding clip of simple and economical design which can be quickly and easily assembled with an electrical wiring device.

A more general object is to provide a wiring device yoke and grounding clip in a novel and improved configuration and relationship.

Another object is to provide means for insuring a ground path between the yoke of a wiring device and a mounting box through the screws which connect the two, such means being assembled with the yoke in a secure manner, whereby inadvertent disconnection is unlikely, yet requiring no permanent connection operations such as welding or brazing.

A further object is to provide an automatic grounding clip for mounting on the yoke of a wiring device in two forms which are respectively adapted for automatic or manual assembly of the clip with the yoke.

Other objects will in part be obvious and will in part appear hereinafter.

SUMMARY OF THE INVENTION

In accordance with the foregoing objects, the present invention contemplates an automatic grounding clip in the form of a wire bent initially in a U-shaped configuration, having a pair of substantially parallel legs with adjacent free ends. The yoke of the wiring device is provided with an opening on each side of the mounting screw openings adjacent the ends of the yoke. That is, a pair of openings for the grounding clips are provided at each end of the yoke, on opposite sides of the opening for the mounting screw.

Both ends of the grounding clip, i.e., the two adjacent terminal ends and the connected ends of the parallel legs, are bent at 90° to the axis of the legs in the same direction. The distance between the bends is substantially equal to the center-to-center spacing of the two openings in the yoke on opposite sides of the mounting screw opening. In a first embodiment, the bent end portions are inserted through the openings provided for the grounding clip and are then bent again at about 90°, toward one another, to secure the clip to the yoke. This operation may be conveniently performed with automatic assembly apparatus.

In a second embodiment, the bent end portions are bent outwardly, away from one another, at about 90° prior to assembly of the clip with the wiring device yoke. This configuration facilitates manual assembly, with the two adjacent terminal ends being placed in one of the clip-mounting openings and the parallel legs flexed to permit insertion in the other opening of the outwardly bent portion of the end joining the legs. Alternatively, one of the clip-mounting openings may communicate with an edge of the yoke by means of a slot to allow the free ends of the clip to be pressed together and inserted through the slot so that the clip may be assembled with the yoke without flexing the parallel legs. In both embodiments, the parallel legs of the clip extend across the mounting screw opening and are contacted and flexed outwardly by the screw passing therebetween, thus insuring a good grounding contact of the wiring device yoke to the clip, the screw, and the mounting box.

The foregoing features and other details of construction and assembly of the invention will be apparent from the following detailed description, taken in conjunction with the accompanying drawing.

DETAILED DESCRIPTION

Figure 1:
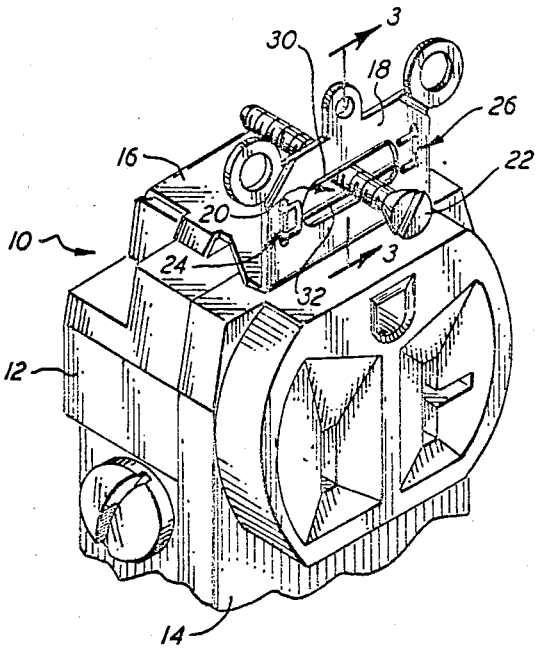
FIG. 1 is a fragmentary, perspective view of an electric receptacle with the automatic grounding clip of the invention in a first embodiment assembled with the receptacle yoke.

Referring now to the drawing, in FIG. 1 is shown a wiring device, generally denoted by reference numeral 10, in the form of a duplex receptacle or wall socket, only about one-half of which is shown. Wiring device 10 includes the usual body 12 and cover 14, both of plastic or other dielectric material and of conventional construction. Cover 14 includes openings for insertion of the prongs of standard electrical plugs for connecting the cord of an appliance or other device to the power and grounding terminals (not shown) of device 10. The terminals for receiving the grounding prong of the plug are riveted or otherwise fixedly attached to rigid metal strap or yoke 16 which has identical; integrally formed, mounting ears 18 at each end, one of which is shown in FIG. 1. Each of ears 18 are provided with openings 20 through which a screw 22 is inserted to attach device 10 to a metal flush box (not shown) which ordinarily is located in a wall of the structure wherein device 10 is utilized.

Figure 4:
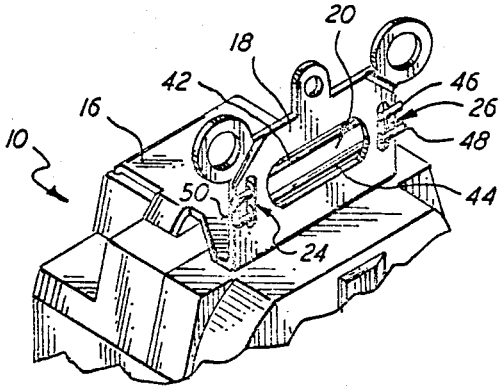
FIG. 4 is a fragmentary, perspective view of a portion of the receptacle with a second embodiment of grounding clip assembled therewith.

It will be noted from FIGS. 1 and 4 that opening 20 is elongated in a direction lateral to ear 18 and is somewhat wider than the diameter of mounting screw 22, as is the usual practice in order to allow for some misalignment of opening 20 and the flush box opening which receives screw 22. Although allowing greater manufacturing tolerances and easier installation, it will be appreciated that this may result in screw 22 not being in firm engagement with yoke 16 to provide the desired ground connection between the yoke and the flush box.

In addition to their conventional features, each of ears 18 is provided with a pair of openings, in addition to opening 20 for the mounting screw, in the construction of the present invention. The openings, denoted in FIG. 1 by reference numerals 24 and 26, are located on opposite sides of opening 20, are considerably smaller than opening 20 and are elongated at 90° to the laterally extending axis of opening 20. Although yoke 16 may have any of a number of configurations, it is conventional in all respects except for the addition of openings 24 and 26 on opposite sides of the mounting screw opening 20 on both ears 18 of device 10.

Figure 2A:
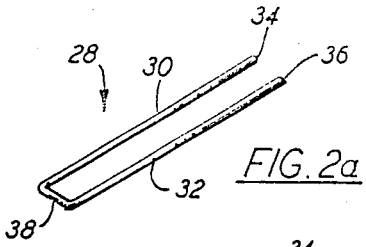
FIGS. 2*a*–2*c* are a series of perspective views of the grounding clip of FIG. 1, illustrating steps in the forming and assembly thereof.
Figure 2B:
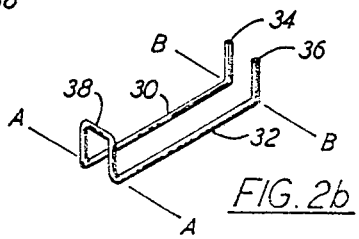
Figure 2C:
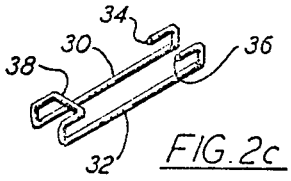

Referring now to FIGS. 2*a*–2*c*, the grounding clip of the invention is shown in a first embodiment. The clip, generally denoted by reference numeral 28, may be formed from a length of 20 AWG phosphor bronze or steel wiring wire. The wire is initially bent in a U-shaped configuration, as shown in FIG. 2*a*, providing a pair of parallel legs 30 and 32 having adjacent, terminal ends 34 and 36, respectively, and joined by intermediate portion 38. Both ends of clip 28 are then bent at substantially 90° to legs 30 and 32 about axes A—A and B—B, perpendicular to the legs and spaced by approximately the center-to-center distance between openings 24 and 26, to provide bent end portions in the configuration shown in FIG. 2*b*. Clip 28 is assembled with yoke 16 by insertion of the bent end portion comprising terminal ends 34 and 36 is then inserted through opening 26 and the end portion comprising portion 38 through opening 24. The portions at each end which extend through openings 24 and 26 are then bent toward one another, to the configuration of FIG. 2*c*, thereby engaging clip 28 with yoke ear 18 in a secure manner, requiring bending of at least one of the end portions back to the position of FIG. 2*c* in order to remove the clip.

Figure 3:
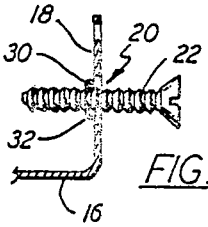
FIG. 3 is a fragmentary, elevations view in section on the line 3—3 of FIG. 1, showing the receptacle mounting screw passing through the yoke opening and the grounding clip.

When clip 28 is engaged with ear 18 in the manner just described, legs 30 and 32 extend across opening 20 parallel with and substantially equidistant from the longitudinal edges thereof. The spacing of legs 30 and 32 is less than the diameter of mounting screw 22. Thus, when screw 22 is inserted through opening 20 to engage the flush box, it contacts both of legs 30 and 32, as seen in FIG. 3, flexing the legs apart to the extent necessary to allow passage of the screw. Since clip 28 is firmly engaged at both ends with ear 18, and engagement of screw 22 with clip legs 30 and 32 is provided by the configuration and orientation of the clip, the desired low resistance ground path between yoke 16 of wiring device 10 and the flush box is assured.

Figure 5A:
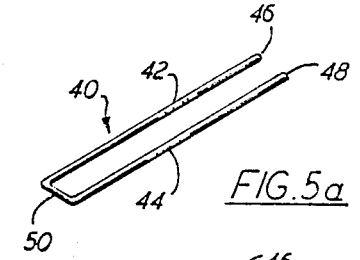
FIGS. 5*a*–5*c* are a series of perspective views of the grounding clip of FIG. 4.
Figure 5B:
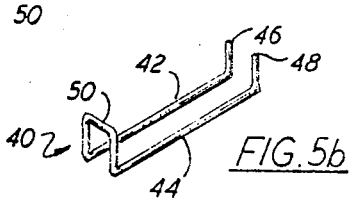
Figure 5C:
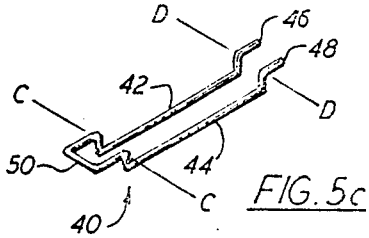

The embodiment of the invention just described is particularly suited to assembly of the clip and wiring device by automated means. That is, the clip may be positioned with the bent end portions extending through openings 24 and 26 and the end portions then further bent toward one another to engage the clip with the yoke ear by conventionally designed machinery. In cases where manual assembly is desired, the clip of FIGS. 4 and 5*c* is preferred. Wiring device 10 and all components thereof, including openings 24 and 26 in yoke ear 18, are the same as in the FIG. 1 embodiment, whereby the same reference numerals are used in FIG. 4.

Clip 40 is initially formed in the same manner as clip 28, with parallel legs 42 and 44, having terminal ends 46 and 48, respectively, and joined by intermediate portion 50, and the end portions bent in the same direction with respect to the legs. Thus, clip 40 in FIGS. 5*a* and 5*b* corresponds exactly to clip 28 in FIGS. 2*a* and 2*b*. The end portions of clip 40, prior to assembly of the clip with the yoke ear, and then bent outwardly about axes C—C and D—D, which are parallel to axes A—A and B—B at intermediate points in the bent end portions, to the configuration of FIG. 5*c*. Terminal ends 46 and 48 may then be inserted through opening 26 and legs 42 and 44 flexed to the extent necessary to permit insertion of portion 50 through opening 24 through manual manipulation of clip 40.

Figure 4A:
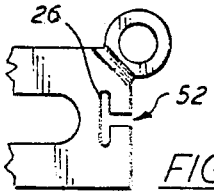
FIG. 4*a* is a fragmentary, elevational view of a modification of the yoke permitting alternate means of assembly of the clip of FIG. 4 with the yoke.

Alternate means of assembly of the clip of FIG. 5*c* with yoke ear 18 may be provided by forming slot 52, extending between opening 26 and the edge of the ear, as shown in FIG. 4*a*. After insertion of portion 50 of the clip through opening 24, legs 42 and 44 are pressed together, permitting the portions thereof adjacent terminal ends 46 and 48 to pass through slot 52. The natural resilience of the wire from which clip 40 is formed returns legs 42 and 44 to their original, parallel position and the clip is engaged with the yoke as shown in FIG. 4.

Although the clip legs in both embodiments are shown positioned on the side of the mounting screw opening opposite that from which the screw is inserted, it is feasible to position the clip with the legs on the front side of the clip ear, i.e., on the same side of the opening from which the mounting screw is inserted. In either case, the simplicity of form of the clip and ease of assembly thereof with the wiring device provide an inexpensive yet totally effective means of assuring a low resistance grounding path between the wiring device yoke and the metal flush box in which the device is mounted. It should also be noted that the clip will retain the mounting screws in position within openings 20 prior to installation, i.e., during packaging and shipment of the wiring device, thereby eliminating the need for the usual, throw-away, fiber or cardboard washers normally used for this purpose.

What is claimed is:

1. A method of forming a single strand of spring wire to provide an automatic grounding clip and for assembling said clip with an electrical wiring device to assure a low resistance electrical connection between said wiring device and a metal flush box wherein it is mounted by a screw extending through an elongated slot having a width greater than the diameter of said screw in a metal yoke of said wiring device to connect the latter with said flush box, said method comprising:

(a) initially bending said wire to an essentially U-shaped configuration to provide two spaced, substantially parallel legs of equal length with adjacent terminal ends and joined by an intermediate portion;

(b) forming first and second openings in said yoke respectively outwardly adjacent opposite ends of said slot;

(c) further bending said U-shaped wire about first and second axes, parallel to one another and perpendicular to said legs, spaced by approximately the center-to-center distance between said openings, to form first and second end portions extending in the same direction from said legs and including said terminal ends and said intermediate portion, respectively;

(d) passing said first and second end portions through said first and second openings, respectively, from a first to a second side of said yoke; and (e) finally bending said first and second end portions over on said second side of said yoke to engage said clip in firm electrical contact with said yoke with said legs extending from side to side across said slot in closely superposed relation therewith, whereby said screw in extending through said slot extends between and in contact with said legs.

2. The method according to claim 1, wherein in said final bending step, said end portions are bent inwardly, toward one another.

3. The method according to claim 2 wherein said screw is inserted through said yoke from said second to said first side thereof, whereby said screw passes through said slot before passing between said legs.

4. The method according to claim 2 wherein, in said further bending step, said first and second axes are spaced by substantially the same respective distances from opposite, outermost ends of said U-shaped wire, whereby said first and second end portions are of substantially the same length.

5. A method of forming a single strand of spring wire to provide an automatic grounding clip and for assembling said clip with an electrical wiring device to assure a low resistance electrical connection between said wiring device and a metal flush box wherein it is mounted by a screw extending through an elongated slot having a width greater than the diameter of said screw in a metal yoke of said wiring device to connect the latter with said flush box, said method comprising:

(a) initially bending said wire to an essentially U-shaped configuration to provide two spaced, substantially parallel legs of equal length with adjacent terminal ends and joined by an intermediate portion;

(b) forming first and second openings in said yoke respectively outwardly adjacent opposite ends of said slot;

(c) further bending said U-shaped wire about first and second axes, parallel to one another and perpendicular to said legs, spaced by approximately the center-to-center distance between said openings, to form first and second end portions extending in the same direction from said legs and including said terminal ends and said intermediate portion, respectively;

(d) finally bending each of said end portions about third and fourth axes, parallel to said first and second axes and between said first and second axes and the outermost ends of the respective end portions outwardly, away from one another, to form said clip with outwardly extending terminal portions at opposite ends; and (e) passing said first and second end portions through said first and second openings, respectively, from a first to a second side of said yoke, whereby said terminal portions extend outwardly from said openings in firm electrical contact with said yoke with said legs extending from side to side across said slot in closely superposed relation therewith, and said screw in extending through said slot extends between and in contact with said legs.

6. The method according to claim 5 and further including forming an additional slot in said yoke, connecting one of said openings and an adjacent edge portion of said yoke, and wherein said step of passing said end portions through said openings includes passing said terminal portion including said adjacent ends through said additional slot.

7. The method according to claim 6 wherein said wire is bent about said first, second, third and fourth axes at approximately 90 degrees, whereby the portions of said wire forming said terminal portions are substantially parallel with said legs.

* * * * *